US006402074B1

(12) United States Patent
Shore et al.

(10) Patent No.: US 6,402,074 B1
(45) Date of Patent: Jun. 11, 2002

(54) APPARATUS FOR TRANSFERRING RINGS FROM AN INCLINED LAYING HEAD ONTO A COOLING CONVEYOR

(75) Inventors: T. Michael Shore, Princeton; Melicher Puchovsky, Dudley; Harold E. Woodrow, Northboro, all of MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/470,672

(22) Filed: Dec. 23, 1999

(51) Int. Cl.[7] ..... B21C 47/24
(52) U.S. Cl. ..... 242/363; 72/134
(58) Field of Search ..... 72/66, 134, 135; 242/361.4, 363; 266/106

(56) References Cited

U.S. PATENT DOCUMENTS 3,405,885 A * 10/1968 Schroder et al. ..... 242/363 X
3,460,777 A * 8/1969 Schröder ..... 242/363 X
4,362,040 A 12/1982 Yamaguchi et al. ..... 72/201
5,024,390 A * 6/1991 Enderlin ..... 242/363 X
5,471,725 A 12/1995 Thrasher ..... 29/91.1
5,634,607 A * 6/1997 Poloni ..... 242/363
5,826,812 A * 10/1998 Hand ..... 242/363
6,056,225 A * 5/2000 David et al. ..... 242/363

FOREIGN PATENT DOCUMENTS

JP 57-39138 4/1982

* cited by examiner

*Primary Examiner*—Janice L. Krizek
(74) *Attorney, Agent, or Firm*—Samuels, Gauthier & Stevens, LLP

(57) ABSTRACT

An apparatus is disclosed for receiving a helical formation of rings of hot rolled steel rod emerging from a laying head, and for depositing the rings on a conveyor for continued transport away from the laying head. The apparatus operates to engage and propel lower portions of the rings towards the conveyor at a first rate of travel, while engaging and propelling upper portions of the rings towards the conveyor at a second rate of travel. The first and second rates of travel are different and selected to cause the rings to topple onto the conveyor in an overlapping offset pattern.

20 Claims, 5 Drawing Sheets

APPARATUS FOR TRANSFERRING RINGS FROM AN INCLINED LAYING HEAD ONTO A COOLING CONVEYOR

BACKGROUND

1. Field of the Invention

This invention relates to an apparatus and method for receiving a continuous series of rings of hot rolled steel rod emerging from a laying head, and for depositing the rings in an ordered overlapping pattern laying substantially flat on a conveyor for continued transport away from the laying head.

2. Description of the Prior Art

In rod mills, it is common practice to pass hot rolled steel rod through a laying head where it is coiled into a helical series of rings. The rings emerging from the laying head are laid on a conveyor in an overlapping pattern where they are subjected to controlled cooling before being gathered into coils in a reforming chamber at the delivery end of the conveyor.

Rings formed from smaller diameter products, e.g., 5 to 26 mm rods, lie relatively flat on the conveyor, particularly when they are laid at elevated temperatures above about 950° C. However, experience has shown that the inherent stiffness of larger diameter products prevents the rings from assuming the desired substantially flat disposition on the conveyor. This is particularly true of the rings formed from the front and tail end portions of a billet length of the product, with the problem being further exacerbated by lower laying temperatures. Thus, for example when processing a 12 mm rod at a laying temperature of about 650° C., the leading and trailing rings will exhibit a tendency to resist laying flat and instead will protrude angularly upwardly from the conveyor. These upwardly protruding rings can disrupt orderly coil formation in the reforming chamber.

In U.S. Pat. No. 5,634,607 (Poloni), an attempt is made at dealing with this problem by temporarily blocking the outlet of the laying head in order to collect the leading rings into a densely packed hank which is then abruptly dropped onto the conveyor. A track assembly overlaying the conveyor is then employed to further flatten the rings passing therebeneath.

A drawback with this approach is that the densely packed leading rings of the accumulated hank do not cool at the same rate as the remainder of the overlapping non-concentric rings. This upsets end-to-end metallurgical uniformity of the resulting product.

Another drawback with this approach is that it does not deal effectively with the trailing rings, which also exhibit a tendency to resist laying flat as they are deposited on the conveyor.

An objective of the present invention is to achieve a substantially flat deposit of uniformly distributed rings on the conveyor, from the leading end to the trailing end of a billet length of product.

A companion objective of the present invention is to achieve the aforesaid flat deposit of rings without disturbing the uniformity of ring exposure to coolant application as the rings proceed along the conveyor to the reforming chamber.

SUMMARY OF THE INVENTION

In accordance with the present invention, lower portions of the individual rings emerging from the laying head are engaged and directed towards the conveyor at a first rate of travel, and upper portions of the rings are simultaneously engaged and directed towards the conveyor at a different second rate of travel, with the difference between the first and second rates of travel causing the rings to be forcibly toppled onto the conveyor. The simultaneous duel engagement of the upper and lower ring portions produces a controlled deposit on the conveyor in a uniform overlapping pattern.

DETAILED DESCRIPTION OF PREFERRED EMBODIMENTS

Figure 1:
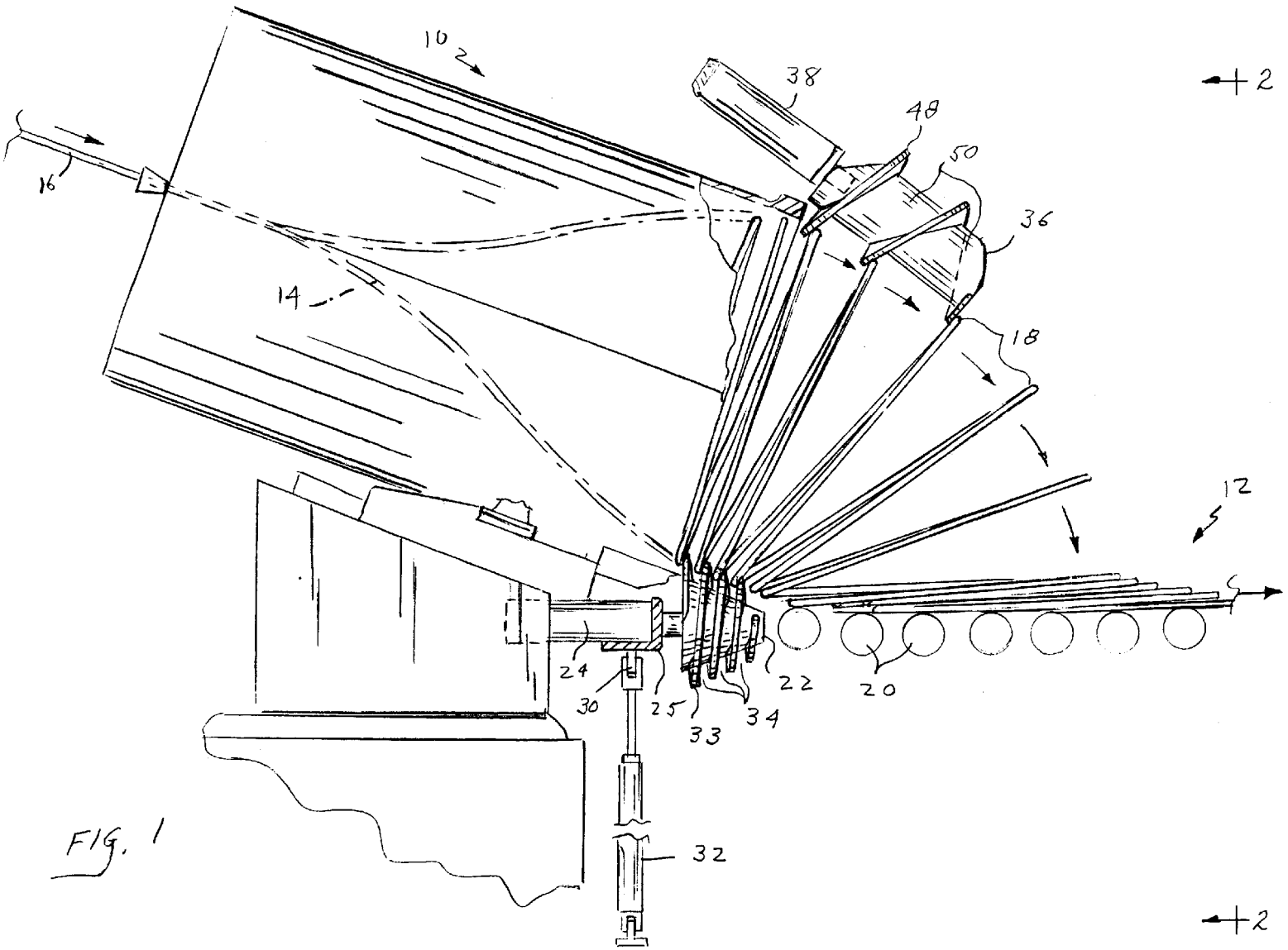
FIG. 1 is a view in side elevation of one embodiment of an apparatus in accordance with the present invention.
Figures 1A, 2:
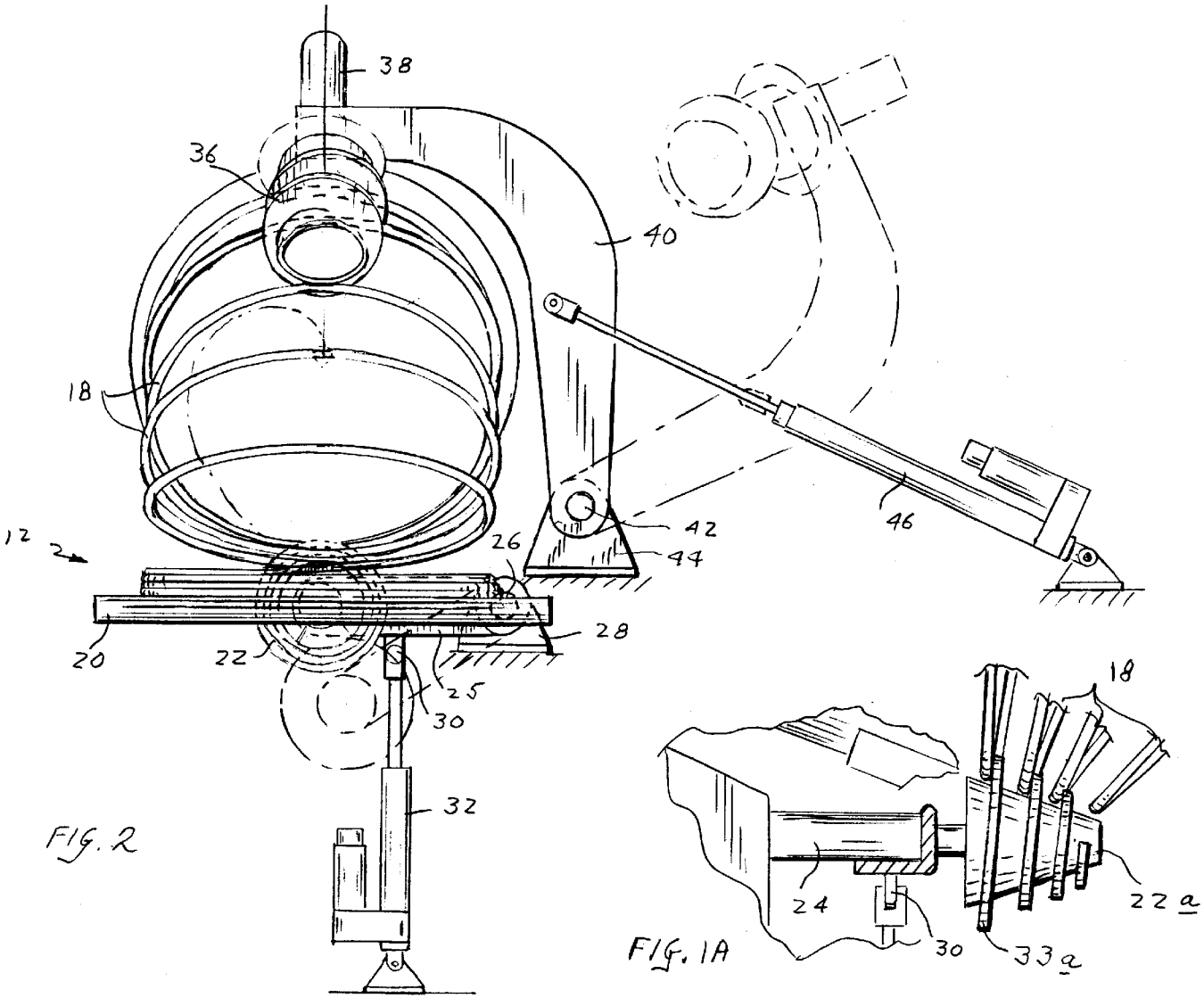
FIG. 1A is a partial view of the apparatus shown in FIG. 1, depicting an alternative embodiment of the mechanism employed to engage and advance the lower ring portions.
FIG. 2 is a sectional view taken along line 2—2 of FIG. 1.

With reference initially to FIGS. 1 and 2, one embodiment of an apparatus in accordance with the present invention is shown in association with a conventional laying head 10 and cooling conveyor 12. The laying head includes a curved laying pipe 14 rotatably driven in a known manner. Hot rolled steel rod 16 is received in the upstream end of the laying pipe and exits from its delivery end as a helical formation of rings indicated typically at 18. The conveyor 12 is also of conventional design, having parallel mutually spaced rollers 20 driven in a known manner to carry the rings received thereon in an overlapping pattern away from the laying head to a reforming chamber (not shown) where they are gathered into large coils.

The lower portions of the rings 18 emerging from the laying head are engaged by a screw 22. The screw is driven by a motor 24 carried on an arm 25 pivotally connected as at 26 to a fixed support 28. The arm 25 is additionally connected as at 30 to the piston rod of an actuator 32, the latter being operable to adjust the screw 22 and its drive motor 24 between the raised operative position illustrated by the solid lines in FIGS. 1 and 2, and an inoperative lowered position indicated by the broken lines in FIG. 2.

The screw 22 has a frustoconical barrel with a spiral flange 33 on its outer surface defining a helical groove 34. The rotational speed of the screw 22 is adjusted to match that of the laying pipe 14, with the result that the lower ring portions are separated one from the other in the helical groove 34 and propelled downwardly by the spiral flange 33 at a first rate of travel towards the conveyor 12.

The upper portions of the rings 18 are engaged by a second screw 36 driven by a motor 38 carried on an arm 40 pivotally connected at 42 to a second stationary support 44. Arm 40 is pivotally adjustable by an actuator 46 for movement between the operative position illustrated by the solid lines in FIGS. 1 and 2, and an inoperative position indicated by the broken lines in FIG. 2.

Screw 36 has a cylindrical barrel surrounded by a spiral flange 48 defining a helical groove 50. The pitch of the upper screw 36 is steeper than that of the lower screw 22. The rotational speed of screw 36 is also matched to that of the laying pipe 14, resulting in the upper ring portions being separated one from the other in the helical groove 50 and propelled downwardly by the spiral flange 48 towards the conveyor 12 at a second rate of travel. The first and second rates of travel of the lower and upper ring portions differ, with the first rate of travel being the slowest, thereby forcibly toppling the rings 18 in a controlled manner onto the conveyor.

The controlled separation and advancement of the lower ring portions is particularly advantageous in that it promotes delivery of the rings in an ordered pattern onto the conveyor 12. Without this feature, the lower ring portions exhibit a tendency to drag and bunch up as they leave the laying head, thus creating mini hanks which produce an uneven pattern on the conveyor.

In FIG. 1A, an alternative embodiment of the lower screw is shown at 22*a*. The spiral flange 33*a* has a gradually diminishing pitch, which results in the lower portions of the rings 18 being propelled towards the conveyor 12 at a gradually decelerating first rate of travel.

While single screws have been described to engage and propel the upper and lower ring portions, it will be understood that the present invention also contemplates the use of multiple laterally disposed screws driven in a coordinated manner.

Figure 3:
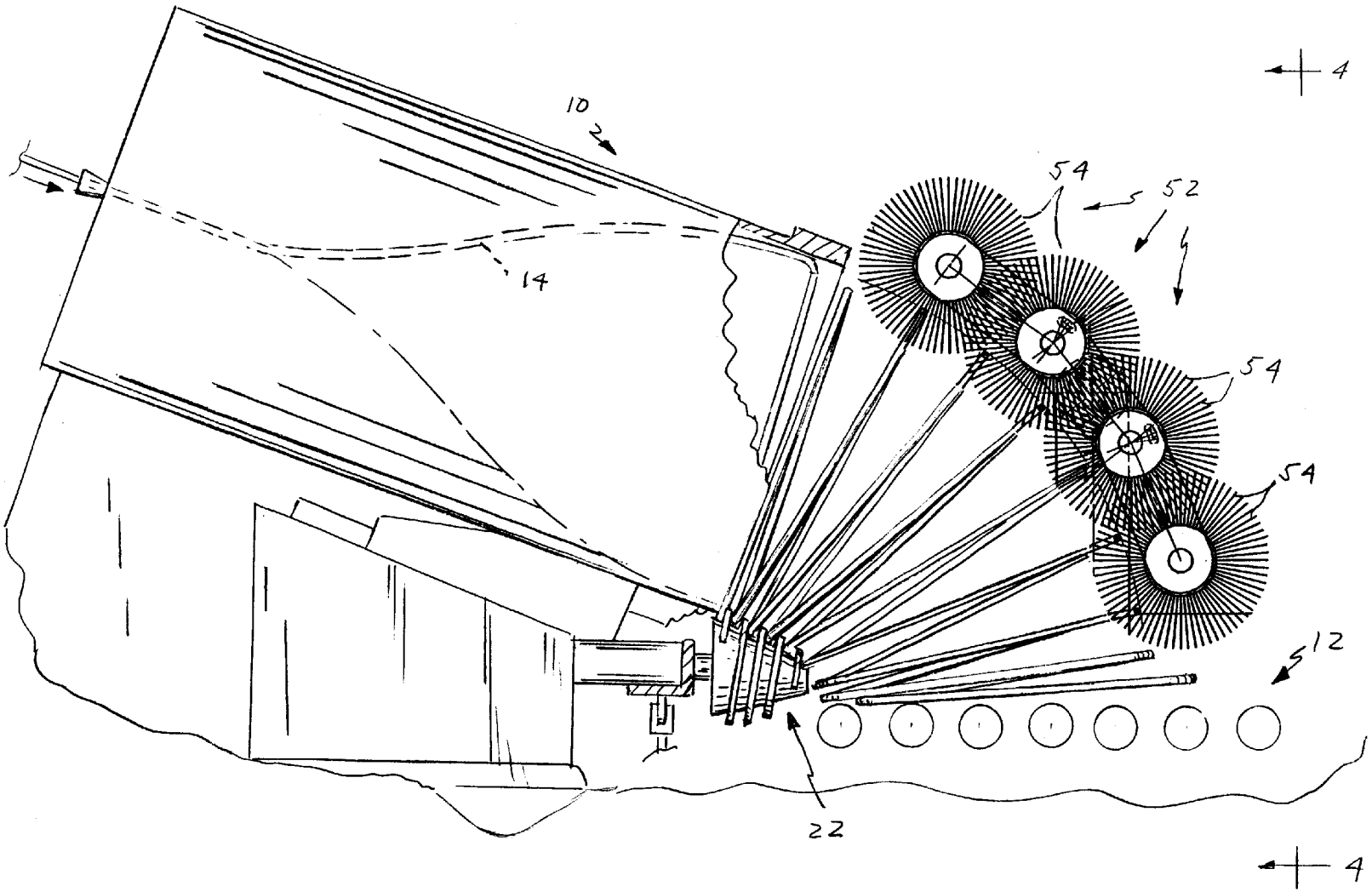
FIG. 3 is a view similar to FIG. 1 showing an alternative embodiment of the invention.
Figure 4:
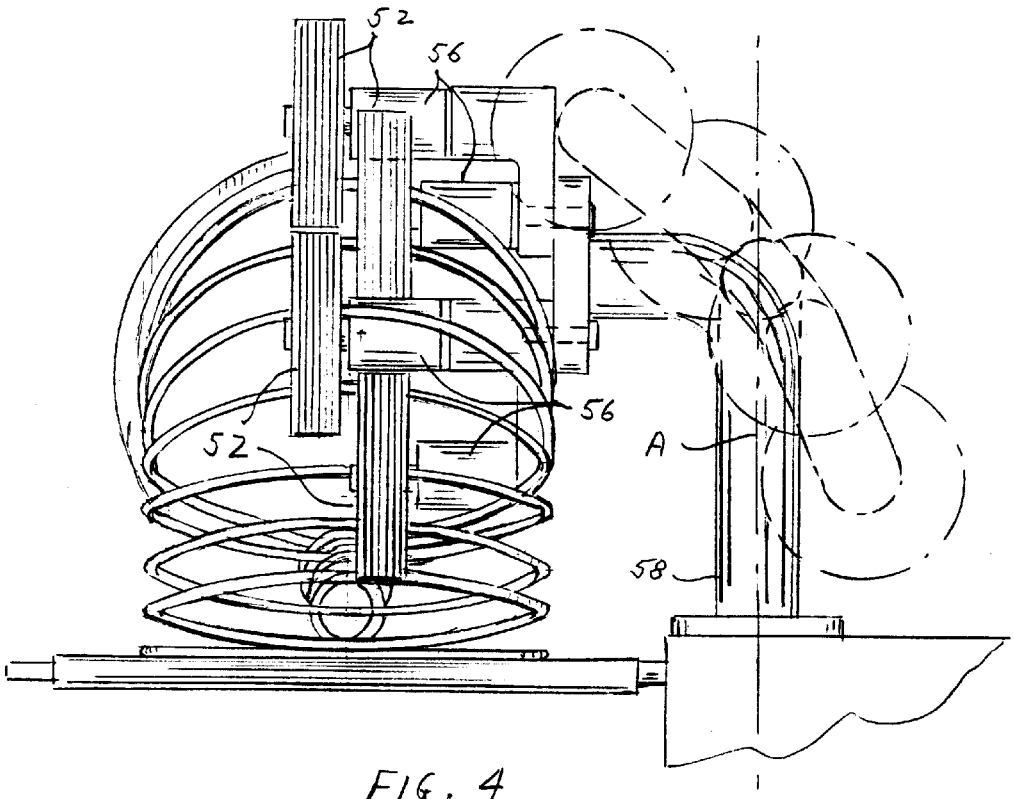
FIG. 4 is a sectional view taken along line 4—4 of FIG. 3.

Referring now to FIGS. 3 and 4, a second embodiment of an apparatus in accordance with the present invention is again shown in association with a conventional laying head 10 and cooling conveyor 12. The lower portions of the rings are again engaged by a screw 22 identical to that shown in FIG. 1. A plurality of brushes 52 having radially projecting bristles are arranged to contact the upper ring portions. The brushes are axially staggered to achieve an overlapping contact pattern, and are individually driven by motors 56 carried on a common support structure 58. The support structure is rotatably adjustable about a vertical axis "A" for movement between an operative position as shown by the solid lines in FIG. 4, and an inoperative position at which the brushes are located 90° from their operative positions as shown by the broken lines in the same view. The brush bristles are suitably resilient, and of a heat resistant material such as for example UNS 517700, which can withstand repeated contact with the rings emerging from the laying head, without becoming permanently deformed, and without scratching or otherwise marring the ring surfaces.

The brushes 52 are rotatably driven at speeds selected to propel the upper ring portions downwardly towards the conveyor 12 at a rate of travel which exceeds that at which the lower ring portions are being propelled by the screw 22.

Figure 5:
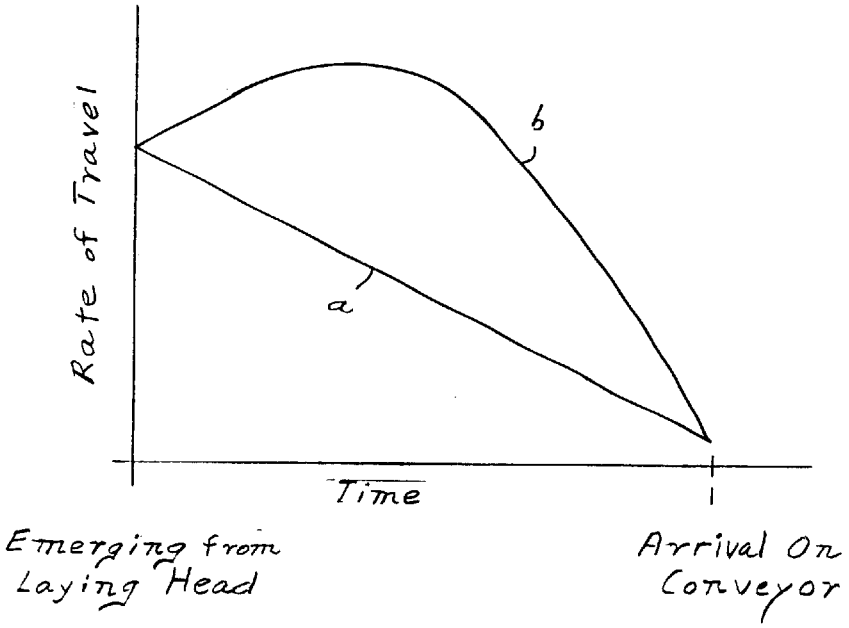
FIG. 5 is a graphical representation of typical rates of travel of the upper and lower ring portions with the embodiment shown in FIGS. 3 and 4.

FIG. 5 graphically depicts a typical speed relationship between the upper and lower ring portions where the lower ring portions are advanced by the mechanism shown in FIG. 1A, and the upper ring portions are directed downwardly by the mechanism shown in FIGS. 1 and 2. The lower ring portions have a gradually decelerating rate of travel depicted by line "a", whereas the upper ring portions have a rate of travel as shown by line "b", which first accelerates and then decelerates to finally equal the rate of travel of the lower ring portions when the rings finally topple onto the conveyor 12.

Figure 6:
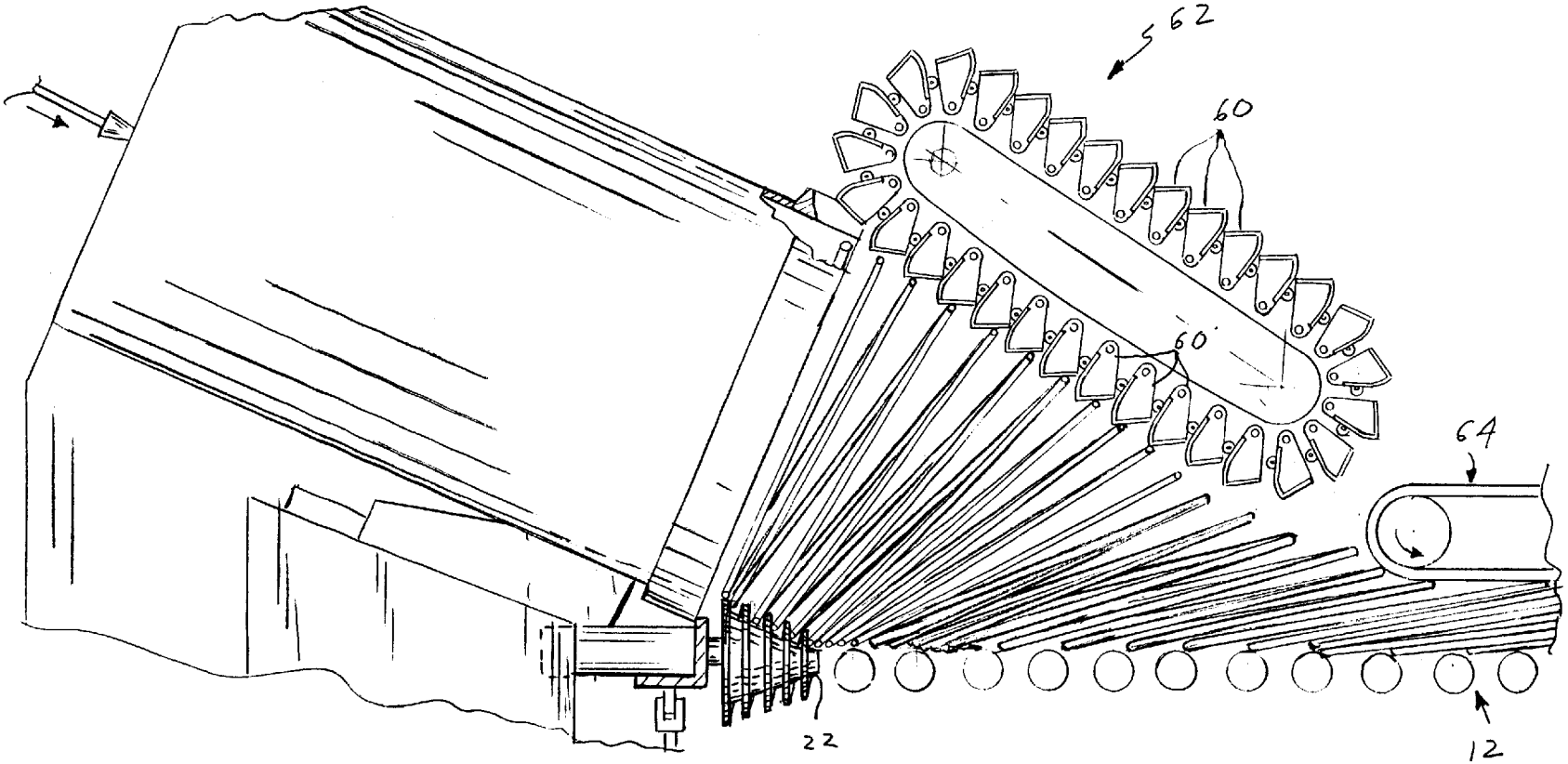
FIG. 6 is a view in side elevation of another embodiment of the invention.

In the embodiment shown in FIG. 6, the lower ring portions are engaged and propelled forwardly by the screw 22 illustrated in FIGS. 1 and 2. The upper ring portions are engaged and propelled downwardly by the pivotal elements 60 of an inclined chain conveyor 62 operating in conjunction with a separately driven horizontal track conveyor 64 parallel to and overlaying the cooling conveyor 12. The conveyors 62 and 64 may be driven at different speeds, e.g., the conveyor 62 may be driven at a speed coordinated with the rotational speed of the laying head, whereas the conveyor 64 may be driven at a speed matching that of conveyor 12.

Conveyor 62 is driven at a speed which propels the upper ring portions downwardly towards the conveyor 12 at a rate of travel which exceeds that of the lower ring portions. Once on the conveyor 12, the rings are further pressed downwardly by the track conveyor 64.

It will now be appreciated by those skilled in the art that with each of the above described embodiments, the rings emerging from the laying head are forcibly toppled onto the conveyor 12 to achieve a flat overlapping pattern. The lower ring portions are engaged separately and propelled forwardly at a controlled rate of travel which is slower than that which is simultaneously being imparted to the upper ring portions. This dual engagement and controlled forward movement promotes uniformity in the resulting overlapping pattern of rings on the conveyor.

We claim:

1. Apparatus for receiving a helical formation of rings of hot rolled steel rod emerging from a laying head and for depositing said rings on a conveyor for continued transport away from said laying head, said apparatus comprising:

first means for engaging and propelling lower portions of said rings towards said conveyor at a first rate of travel; and second means for engaging and propelling upper portions of said rings downwardly along a curved path towards said conveyor at a second rate of travel, said second means comprising at least one screw member configured and arranged to engage said upper ring portions at multiple locations along said path, and means for rotating said screw member, said first and second rates of travel being different and selected to cause said rings to topple onto said conveyor in an overlapping offset pattern.

2. A method of receiving a continuous series of rings of hot rolled steel rod emerging from an inclined laying head and for depositing said rings on a conveyor for continued transport away from the laying head, said method comprising:

engaging and propelling lower portions of said rings towards said conveyor at a first rate of travel; and simultaneously engaging and propelling upper portions of said rings downwardly along a curved path towards said conveyor at a second rate of travel, the upper portions of said rings being engaged and propelled downwardly at multiple locations along said path, said second rate of travel being different from said first rate of travel to thereby cause said rings to topple onto said conveyor.

3. The method of claim 2 wherein said rings are maintained in a mutually spaced relationship prior to their being deposited on said conveyor.

4. The method of claim 2 wherein said first rate of travel is slower than said second rate of travel.

5. The method of claim 4 wherein said first rate of travel is continuously decelerating.

6. The method of claim 5 wherein said second rate of travel is initially accelerated and then decelerated to equal said first rate of travel.

7. Apparatus for receiving a helical formation of rings of hot rolled steel rod emerging from a laying head and for depositing said rings on a conveyor for continued transport away from said laying head, said apparatus comprising:

first means for engaging and propelling lower portions of said rings towards said conveyor at a first rate of travel; and second means for propelling upper portions of said rings downwardly along a curved path towards said conveyor at a second rate of travel, said second means being configured and arranged to contact the upper portions of said rings at multiple locations along said path, and said first and second rates of travel being different and selected to cause said rings to topple onto said conveyor in an overlapping offset pattern.

8. The apparatus as claimed in claim 7 wherein said second means comprises at least one screw member configured and arranged to engage said upper ring portions, and means for rotating said screw member.

9. The apparatus as claimed in claim 7 wherein said second means comprises a continuous chain conveyor, and means for driving said chain conveyor.

10. Apparatus for receiving a helical formation of rings of hot rolled steel rod emerging from a laying head and for depositing said rings on a conveyor for continued transport away from said laying head, said apparatus comprising:

first means for engaging and propelling lower portions of said rings towards said conveyor at a first rate of travel; and second means for engaging and propelling upper portions of said rings downwardly along a curved path towards said conveyor at a second rate of travel, said second means comprising a continuous chain conveyor structured and arranged to engage the upper portions of said rings at multiple locations along said path, and means for driving said chain conveyor, said first and second rates of travel being different and selected to cause said rings to topple onto said conveyor in an overlapping offset pattern.

11. The apparatus as claimed in claims 9 or 10 further comprising a second continuous track conveyor configured and arranged to contact and flatten the overlapping offset pattern of rings on said conveyor, and means for driving said second track conveyor.

12. The apparatus as claimed in claim 11 wherein said second track conveyor is driven at a speed different from that at which said chain conveyor is being driven.

13. The apparatus as claimed in claim 7 wherein said second means comprises at least one rotatable brush having radially extending bristles arranged to resiliently contact the upper portions of said rings, and means for rotatably driving said brush.

14. Apparatus for receiving a helical formation of rings of hot rolled steel rod emerging from a laying head and for depositing said rings on a conveyor for continued transport away from said laying head, said apparatus comprising:

first means for engaging and propelling lower portions of said rings towards said conveyor at a first rate of travel; and second means for engaging and propelling upper portions of said rings towards said conveyor at a second rate of travel, said second means comprising at least one rotatable brush having radially extending bristles arranged to resiliently contact the upper portions of said rings, and means for rotatably driving said brush, said first and second rates of travel being different and selected to cause said rings to topple onto said conveyor in an overlapping offset pattern.

15. The apparatus as claimed in claim 13 or 14 wherein a plurality of said brushes are arranged in an overlapping relationship.

16. The apparatus as claimed in claim 7 wherein said first means comprises at least one screw member configured and arranged to engage said lower ring portions, and means for rotating said screw member.

17. The apparatus as claimed in claim 16 wherein said screw member has a frustoconical barrel with a spiral flange on its outer surface defining a helical groove.

18. The apparatus as claimed in claims 7 or 16 wherein said first rate of travel is slower than said second rate of travel.

19. The apparatus as claimed in claim 18 wherein said first rate of travel is continuously decelerating.

20. The apparatus as claimed in claim 19 wherein said second rate of travel is initially accelerated and then decelerated to equal said first rate of travel.

* * * * *